US010340602B2

(12) United States Patent
Tzuang et al.

(10) Patent No.: US 10,340,602 B2
(45) Date of Patent: Jul. 2, 2019

(54) RETRO-DIRECTIVE QUASI-OPTICAL SYSTEM

(71) Applicant: Ching-Kuang C. Tzuang, Hsinchu County (TW)

(72) Inventors: Lawrence Dah-Ching Tzuang, Hsinchu (TW); Ching-Kuang C. Tzuang, Hsinchu (TW)

(73) Assignee: Ching-Kuang C. Tzuang, Hsinchu (TW)

( * ) Notice: Subject to any disclaimer, the term of this patent is extended or adjusted under 35 U.S.C. 154(b) by 0 days.

(21) Appl. No.: 15/830,379

(22) Filed: Dec. 4, 2017

(65) Prior Publication Data

US 2018/0159244 A1 Jun. 7, 2018

Related U.S. Application Data

(60) Provisional application No. 62/429,228, filed on Dec. 2, 2016.

(51) Int. Cl.

| | |
|---|---|
| ***H01Q 3/24*** | (2006.01) |
| ***H01Q 3/26*** | (2006.01) |
| ***H01Q 15/02*** | (2006.01) |
| ***H01Q 15/14*** | (2006.01) |

(Continued)

(52) U.S. Cl.

CPC ..... *H01Q 19/062* (2013.01); *H01Q 3/245* (2013.01); *H01Q 3/2647* (2013.01); *H01Q 15/148* (2013.01); *H01Q 25/007* (2013.01); *H01Q 15/02* (2013.01)

(58) Field of Classification Search

None

See application file for complete search history.

(56) References Cited

U.S. PATENT DOCUMENTS 5,583,511 A * 12/1996 Hulderman ..... G01S 13/426 342/157
6,404,398 B1 * 6/2002 Chen ..... H01Q 1/288 342/368
7,994,996 B2 8/2011 Rebeiz et al.

(Continued)

OTHER PUBLICATIONS

P. F. Goldsmith et al. "Focal Plane Imaging Systems for Millimeter Wavelengths," IEEE Transactions on Microwave Theory and Techniques, vol. 41, No. 10, p. 1664 (1993).

(Continued)

*Primary Examiner* — Howard Williams

(74) *Attorney, Agent, or Firm* — WPAT, PC

(57) ABSTRACT

The proposed retro-directive quasi-optical system includes at least a lens set and a pixel array. The lens set is positioned on one side of the pixel array and the lens set instantly establishes retro-directive space channels between the pixels in the pixel array and the object(s) distributed in the accessible space defined by the lens set through infinite or finite conjugation. In the pixel array, a number of pixels are arranged as an array and each pixel is composed of at least one pair of transmitter antenna and receiver antenna. To guarantee that the electromagnetic waves transmitted from a pixel into the accessible space may be reflected back to the receiver of the same pixel, the size of each pixel is not larger than the point-spread spot size defined by the lens set, wherein the point-spread spot size can be contributed either from lens diffraction or aberration.

20 Claims, 12 Drawing Sheets

(51) Int. Cl.
*H01Q 19/06* (2006.01)
*H01Q 25/00* (2006.01)

(56) References Cited

U.S. PATENT DOCUMENTS

| | | | | |
|---|---|---|---|---|
| 8,811,511 | B2 | 8/2014 | Sayeed et al. | |
| 2012/0013517 | A1* | 1/2012 | Lee | H01Q 13/22 343/785 |
| 2018/0267138 | A1* | 9/2018 | Sakurai | G01S 7/03 |

OTHER PUBLICATIONS

Axel Tessmann et al. "Compact Single-Chip W-Band FMCW Radar Modules for Commercial High-Resolution Sensor Applications," IEEE Transactions on Microwave Theory and Techniques, vol. 50, No. 12, p. 2995 (2002).

Sen Wang et al. "Design of X-Band RF CMOS Transceiver for FMCW Monopulse Radar," IEEE Transactions on Microwave Theory and Techniques, vol. 57, No. 1, p. 61 (2009).

* cited by examiner

RETRO-DIRECTIVE QUASI-OPTICAL SYSTEM

FIELD OF THE INVENTION

The present invention relates to a retro-directive quasi-optical system, which is capable of interacting with many spatially distributed object(s) simultaneously, especially, the proposed system uses a lens set having one or more lenses to establish the space channels that correlate each, or part, of the objects distributed in space with one or some pixels within a pixel array, wherein each pixel in the pixel array is composed of one or more Tx (transmitter) antennas and one or more Rx (receiver) antennas.

BACKGROUND OF THE INVENTION

In modern days, many devices require remote interaction with spatially distributed objects for a number of applications. For example, remote detection of high-resolution imagery, by means of cameras, is indispensable for social media, artificial-intelligence systems, self-driving cars, security tools, and so on. However, light cannot penetrate opaque obstacles, and it can be easily disturbed by fog and rain, or scattered by textured surfaces, or absorbed by black substances, potentially leading to unexpected events or even fatal accidents. On the other hand, conventional radio-frequency (RF) technologies can resolve the aforementioned problems, but the component size is typically large, preventing widespread application of RF technologies in imaging, detection, dense wireless communication networks, etc. Recently, the rapid advancement of high-frequency mm-wave and THz (Tera-Hertz) technologies makes the RF apparatus of smaller form factor be practical of monitoring, sensing, and communicating with objects distributed over a large space simultaneously, thereby resolving most of the issues associated with light-wave apparatus at lower and affordable cost. For another example, future wireless base station calls for complicated, dense, and user-scaling RF communication technology to trace numerous mobile devices dynamically so that their communications with the base station are stable. However, such complexity inevitably leads to both high power consumption and high cost, bringing great pressure on RF communication equipment providers.

There are at least two main candidate electromagnetic (EM) solutions known to date for a local device to interact with remote objects electronically: the first is the phased array system and the second is the lens-based image array system. Here briefly mentions the operation principle of the phased array system: numerous phase-shifting elements are arranged as an array, and the phase of each element is adjusted such that the EM waves (electromagnetic waves) emitted from (received by) all the elements are synthesized into a focused EM beam pointing to (or receiving from) a specific direction. This allows searching or delivering signals in the form of EM waves through different space channels to the remote objects of interest. Next is the brief summary of the operation principle of the lens-based image array system: a lens set is positioned in front of a pixel array, and each pixel consists of an EM wave receiver, so that any EM wave transmitted from the objects may be collected by the lens and then processed by a detector located at a specific position on the focal plane of the lens set. Furthermore, the optical properties of the lens-based image array system may be adjusted by interchanging the lens set (e.g. lenses with different field of views (FOV) and/or other optical properties that may be used independently).

All currently available technologies, however, still have obvious disadvantages. For example, the phased array system requires large and continuous computing power to synthesize the EM waves for beam steering and searching, which results in waste of computing time and energy. In addition, when moving to a higher bandwidth system that requires higher carrier frequencies, the phased array technology becomes increasingly complex because a large amount of high-frequency components such as antennas and phase shifters with sophisticated control scheme and calibrations are required, making the frequency scaling of phased array technology increasingly difficult. Even worse, the phase shifters in general not only requires control power, but also induces extra EM wave losses, nonlinearities (both in terms of power and frequency), and noise. On the other hand, state-of-the-art lens-based image array system only focuses on the EM wave reflected from the spatially distributed objects and through the passive lens set onto different locations in the focal plane, just like a traditional light-wave camera, which does not require any active components and algorithms for beam steering. [Refer to P. F. Goldsmith, C. T. Hsieh, G. R. Huguenin, J. Kapitzky, and E. L. Moore, "Focal Plane Imaging Systems for Millmeter Wavelengths" IEEE Transactions on Microwave Theory and Techniques, Vol. 41, No. 10, p. 1664-1675 (1993)]. The lens focusing property had been also used as an imaging antenna for automotive radars, utilizing a hemispherical lens with a backside reflector nearby the focal plane to generate a scanning multibeam radiation pattern by arranging an end-fire tapered slot antenna array positioned in a circular arc surrounding the hemispherical lens. [Refer to B. Schoenlinner, and G. M. Rebeiz, "Compact Multibeam Imaging Antenna for Automotive Radars," IEEE MTT-s Digest, p. 1373-1376 (2002)]. [Refer to U.S. Pat. No. 7,994,996 B2: "MULTIBEAM ANTENNA," Inventors: Gabriel Rebeiz, James P. Ebling, and Bernhard Schoenlinner.] The microwave, millimeter-wave, and THz imaging array systems typically need high-power sources to obtain sufficient SNR (signal to noise ratio) to achieve the image quality close to the level of lightwave camera, despite that all the lightwave camera do not need any active components and algorithms for beam steering. Recently, the lens focusing properties were also adapted to the beamspace MIMO (maximum input maximum output) communication, which consists of discrete lens array (DLA) made of several laminated, planar surfaces patterned with sub-wavelength, bandpass, frequency-selective, phase shifters, thus constituting a continuous-aperture-phased artificial lens system of antenna (aperture) size A of spatial signal space dimension, $n=4A/\text{lambda}^2$ (lambda is the free-space wavelength of the operating frequency.) The antenna aperture was coupled to p transceivers ($p<<n$) with p antenna feeds mounted on the focal plane, through which the MIMO algorithms controlled and steered the transmitted or received beams. The lens-based beam space MIMO still necessitated extensive signal processing power to cope with practical point-to-point and point-to-multi-point scenarios. [Refer to U.S. Pat. No. 8,811,511 B2: "HYBRID ANALOG-DIGITAL PHASED MIMO TRANSCEIVER SYSTEM," Inventors: Akbar M. Sayeed, Madison, Wis. (US); Nader Behdad, Madison, Wis. (US)] [Refer to J. Brady, N. Behdad, and A. M. Sayeed, "Beamspace MIMO for Millimeter-wave Communications: System Architecture, Modeling, Analysis, and Measurements", IEEE Transactions of Antennas and d Propagation, Vol. 61, No. 7, p. 3814-3827 (2013)].

Accordingly, it is desired to develop new technology for providing efficient remote object interaction, such as imaging, detection, communication, or other applications.

SUMMARY OF THE INVENTION

The present invention proposes a retro-directive quasi-optical system configured to interact with remotely distributed objects. The proposed system features fast-switching, low-cost, power-efficient, flexible, high-resolution and more suitable for high-frequency EM waves in the millimeter wave (mmWave) or terahertz (THz) regime.

The proposed retro-directive quasi-optical system includes at least a lens set and a pixel array, wherein the lens set has at least one or more lenses and the pixel array has some pixels wherein each pixel is composed of at least two antennas, one or more of them are connected to one or more transmitters (Tx) and the others are connected to one or more receivers (Rx), which define the locations where the EM wave is transmitted and received, respectively. The Tx includes circuit elements that convert the electrical signal to outgoing EM wave, and the Rx also includes circuit elements that convert the incoming EM wave into electrical signal. Also, the Tx and Rx may include other circuit elements, such as emitters, oscillators, detectors, amplifiers, switchers, filters, EM splitters, and EM combiners etc., to more efficiently generate or detect EM waves, respectively. Note that the physical boundary of each pixel is only defined by the combined size of its antennas excluding the Tx and Rx, and both Tx and Rx may be fully or partially positioned inside the pixel boundary. The lens set instantly creates unique conjugate points between the specific pixel in the pixel array and the corresponding position of remotely distributed objects within the accessible space defined by the lens set. [Refer to W. Wetherell, "A focal systems," Handbook of Optics, vol. 2, p. 2.2, 2004]. In addition, based on the Lorentz reciprocity theorem, [Refer to L. D. Landau and E. M. Lifshitz, "Electrodynamics of Continuous Media", (Addisp-Wesley: Reading, Mass., 1960), p. 288], the relationship between a specific pixel exciting EM waves and the resulting focused EM waves on a remote object is unchanged if one interchanges the points where the excitation is placed and where the EM waves are focused on. In other words, a unique and retro-directive space channel mapping is created for all the object-to-pixel-pairs simultaneously without the need of additional computation or wave-synthesis techniques. Hence, in comparison with the phased-array or MIMO, it removes active control and computation for beam steering and their associated hardware and devices. Therefore, the EM waves emitted from each of the pixels may be transmitted to each of the corresponding object positions within the accessible space defined by the lens set, and the reflected or scattered EM waves from the object positions reach the same transmitting pixel of the quasi-optical lens system, thus manifesting the retro-directive properties of the proposed quasi-optical RF system. In addition, the accessible space is defined by the optical properties of the lens set, such as field-of view, even such as the effective focal length and/or the f-number. However, the dimensions of the lenses are in the order of few wavelengths to several hundreds of wavelengths, rendering a quasi-optical lens system. Furthermore, it is required that the size of each pixel is not larger than the point-spread spot size of the lens set, which guarantees that the EM waves emitted from the Tx of a certain pixel will be scattered or reflected back from a remote object of interest, and impinge on the lens set, then reach the Rx of the same pixel on the focal plane with the limited spread spot size. The point-spread spot size can be attributed to both diffraction and aberration of a quasi-optical lens set.

In general, the design of the lens set and the pixel array depends on different applications. Similar to typical cameras when focusing is important at close distances, the distance between the pixel array and the lens set should be optimized. In addition, the lens set can be interchangeable to achieve specific quasi-optical properties such as its field of view. Furthermore, the consideration of the size of the lens set, the amount of pixels, and the distribution of the pixels depends on application; but typically, the tradeoff is between resolution and cost. Moreover, both the transmitter and the receiver corresponding to each pixel can be turned on or off at any time during operation, and the transmitter can adjust its frequency, polarization, phase, and/or the magnitude of the generated EM wave depending on different scenarios or simply saving power. In addition, the proposed quasi-optical system is more suitable for high frequency EM wave, such as the microwave wave or the Terahertz (THz) within the frequency range from 10 GHz to 1 THz. The THz wavelengths are smaller than the millimeter wavelength. Given a lens system with a focal plane diameter of 10 cm, and assuming the pixel size is of one operating free-space wave-length, the lens system can adopt 10 pixels along the diameter plane at 30 GHz, 33 pixels at 100 GHz, 333 pixels at 1 THz, and so on. While maintaining the same size of the lens system, the resolution of the object image increases with increased operating frequency. Conversely, when maintaining the same resolution (and thus the same number of pixels), the dimension of lens system is proportional (inversely proportional) to the wavelength (operating frequency). Particularly, with recent steadfastly improving manufacturing capability, and the maximum transistor unity-gain frequency ($f_{max}$) beyond THz is achievable, the proposed quasi-optical system can operate at even higher EM wave frequencies as long as the pixel size is smaller than the point-spread dimension.

DETAILED DESCRIPTION OF THE INVENTION

Figure 1A:
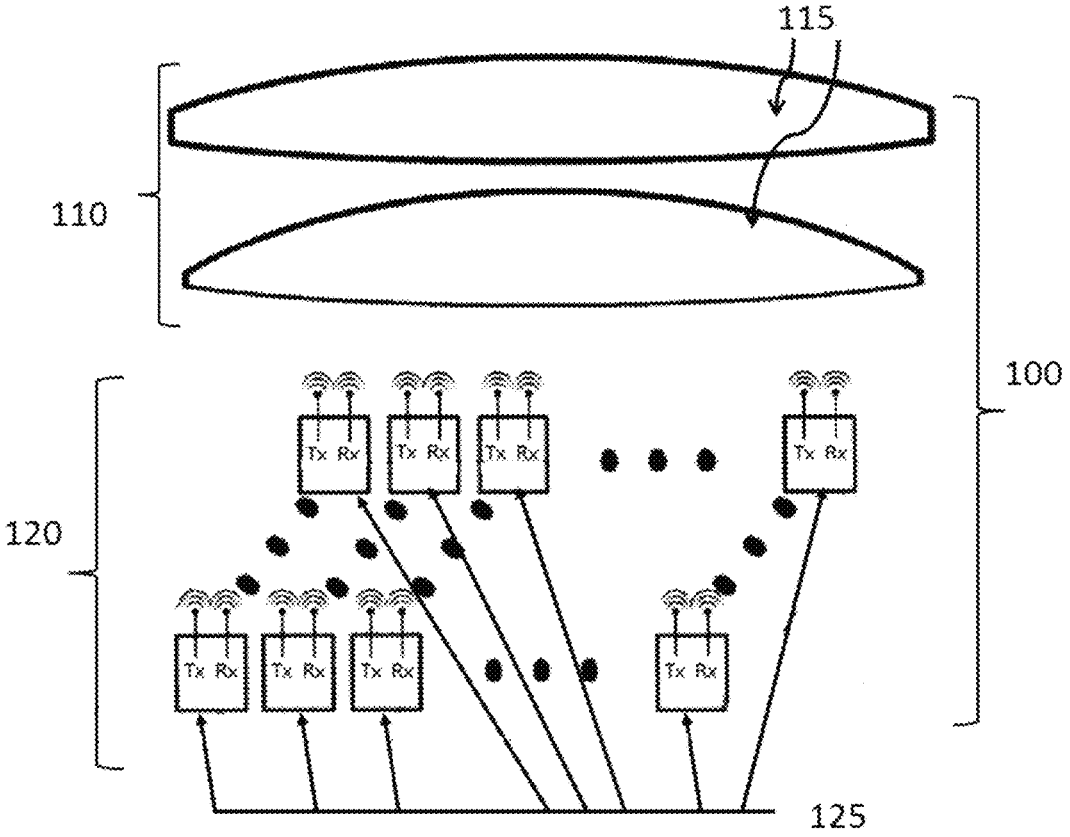
FIG. 1A illustrates the proposed retro-directive quasi-optical system, and both

The invention, as shown in FIG. 1A, is related to a retro-directive quasi-optical system 100 that includes at least a lens set 110 and a pixel array 120, wherein a two-dimensional array resides on a two-dimensional surface is present as an example. The pixel array 120 sets the resolution of the quasi-optical system. The lens set 110 has one or more lens 115, and the pixel array 120 has some pixels 125 wherein each pixel is composed of one or more transmitter (Tx) antennas and one or more receiver (Rx) antennas, which define the locations where EM wave are transmitted and received, and the physical size of each pixel may be defined as the area enclosed by the Tx and Rx antennas. One or more transmitters are connected to the Tx antenna(s) and convert the electrical signals to the outgoing EM waves, and one or more receivers are connected to the Rx antenna(s) and convert the incoming EM waves into the electrical signals. Also, the Tx and Rx may include other circuit elements, such as amplifiers, switches, filters, oscillators, mixers, emitters, detectors, EM splitters, EM combiners etc., to more efficiently generate or detect EM waves, respectively, or to serve other purposes such as system-level controls and signal processing. For example, the circuit elements may have the following basic forms: an emitter and/or an oscillator for Tx, and a switch, an amplifier, and a detector for Rx. For example, the circuit elements may include one or more EM splitters and/or one or more EM combiners for further modifying the transmitted and/or received EM wave. Note that both the Tx and Rx can also be partially or fully located inside the pixel boundary defined by the Tx and Rx antennas, even both Tx and Rx can be fully located outside the pixel boundary defined by the Tx and Rx antennas. Two examples are given for scenarios where the pixels including only the Tx and Rx antennas would be beneficial: 1) local heat removal from the pixel is important, and 2) the combined size of the circuit elements is larger than the desired pixel size. Further, the connections between the Tx (Rx) and the Tx (Rx) antenna(s) are not limited herein. For example, each Tx and Rx may connect to one or multiple antennas within one pixel. In addition, each Tx antenna and Rx antenna can also be connected to multiple Tx and Rx for one pixel. However, FIG. 1A shows only an example case that each pixel has one set of Tx antenna and Tx, and one set of Rx antenna and Rx. The optical properties of the lens set 110, specifically, the field-of-view (FOV), the effective focal length (EFL) and/or the f-number, characterize the retro-directive space channels between the pixel array 120 and the accessible space defined by the lens set 110. The accessible space is positioned on the opposite side of the lens set 110. In this way, each portion of the accessible space is one-to-one mapped to a single pixel of the pixel array 120 through infinite and finite conjugations (focusing at infinite and finite distances). For example, the EM waves emitted by the first specific pixel may be transmitted (or viewed as mapped) by the lens set 110 to the first specific portion of the accessible space (not shown in FIG. 1A.) Similarly, any EM waves either transmitted, reflected, or scattered from the second specific portion of the accessible space may be received (or viewed as mapped) by the lens set 110 at the second specific pixel. Since the mapping is both unique and bi-directional, the lens set instantly and simultaneously creates a number of retro-directive space channels between the local pixel array and the remote accessible space. The dimension of the space channels equals to the total number of pixels.

Figure 1B:
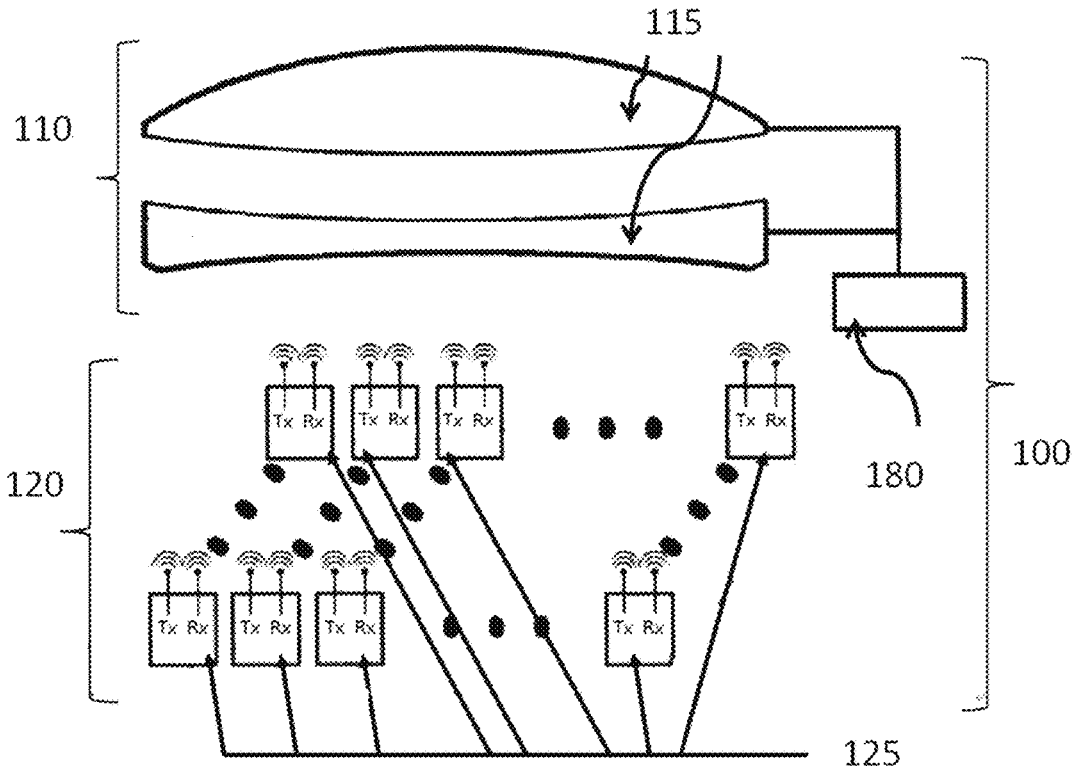
FIG. 1B and FIG. 1C illustrate two variations of the proposed retro-directive quasi-optical system.
Figure 1C:
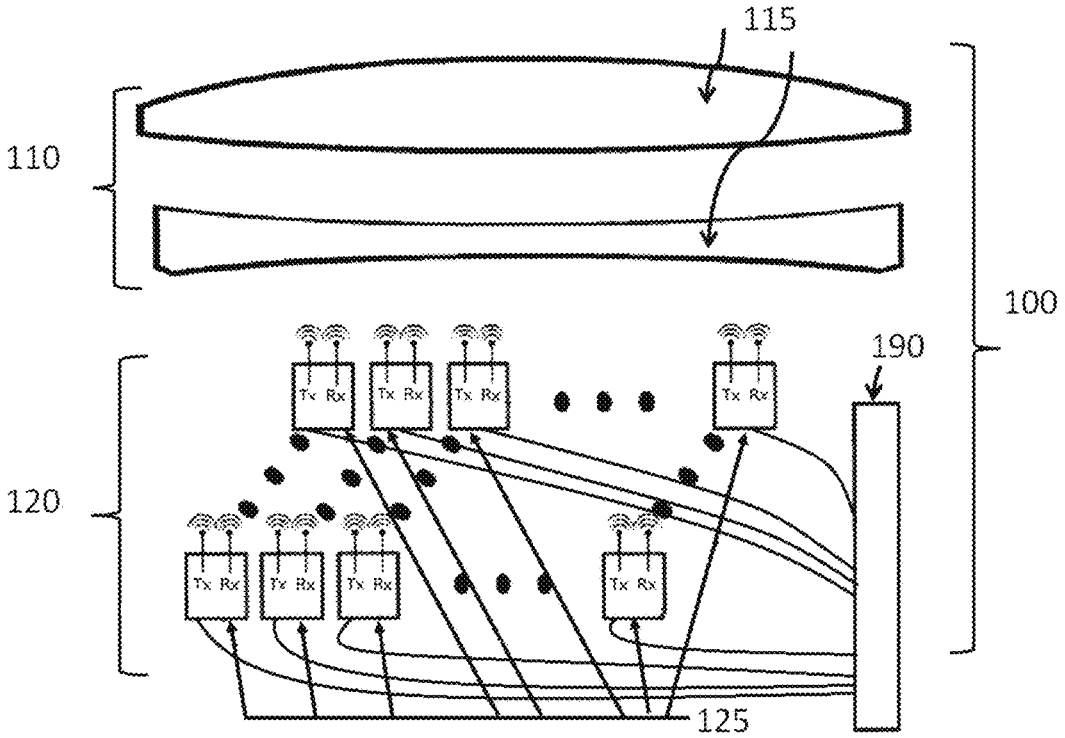

The geometrical relation between the lens set and the pixel array may be optimized, i.e., the proposed system may be configured according to the required specifications such as resolution and beam width. As shown in FIG. 1B and FIG. 1C, some embodiments may have a lens driving mechanism 180 to move and/or tilt at least one lens 115 of the lens set 110, also some other embodiments may have a pixel driving mechanism 190 to move and/or tilt at least one pixel 125 of the pixel array 120. The details of both the lens driving mechanism 180 and the pixel driving mechanisms 190 are not limited. For example, motors, gearboxes, sliders, actuators, any function-equivalent mechanical devices, or any combination of these mechanical devices may be used. Besides, each lens 115 of the lens set 110 and each pixel 125 of the pixel array 120 may be replaced by other lens and other pixel, i.e., both the spatial orientation of the pixel array 120 (including both the pixel spacing and their arrangements) and the size and shape of the lens set 110 can be designed to meet the required resolution and signal-to-noise ratio for specific applications.

Figure 2A:
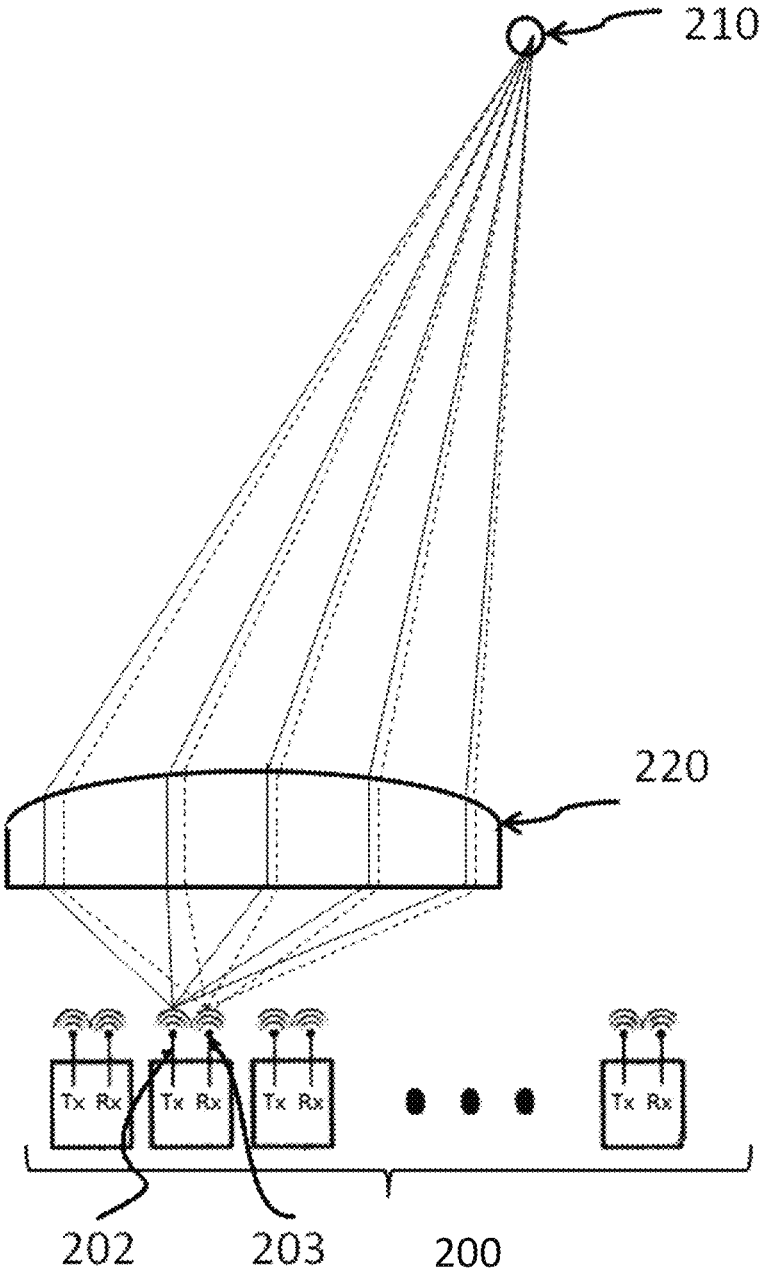
FIG. 2A and FIG. 2B are two diagrams showing the working mechanism of the proposed retro-directive quasi-optical system.
Figure 2B:
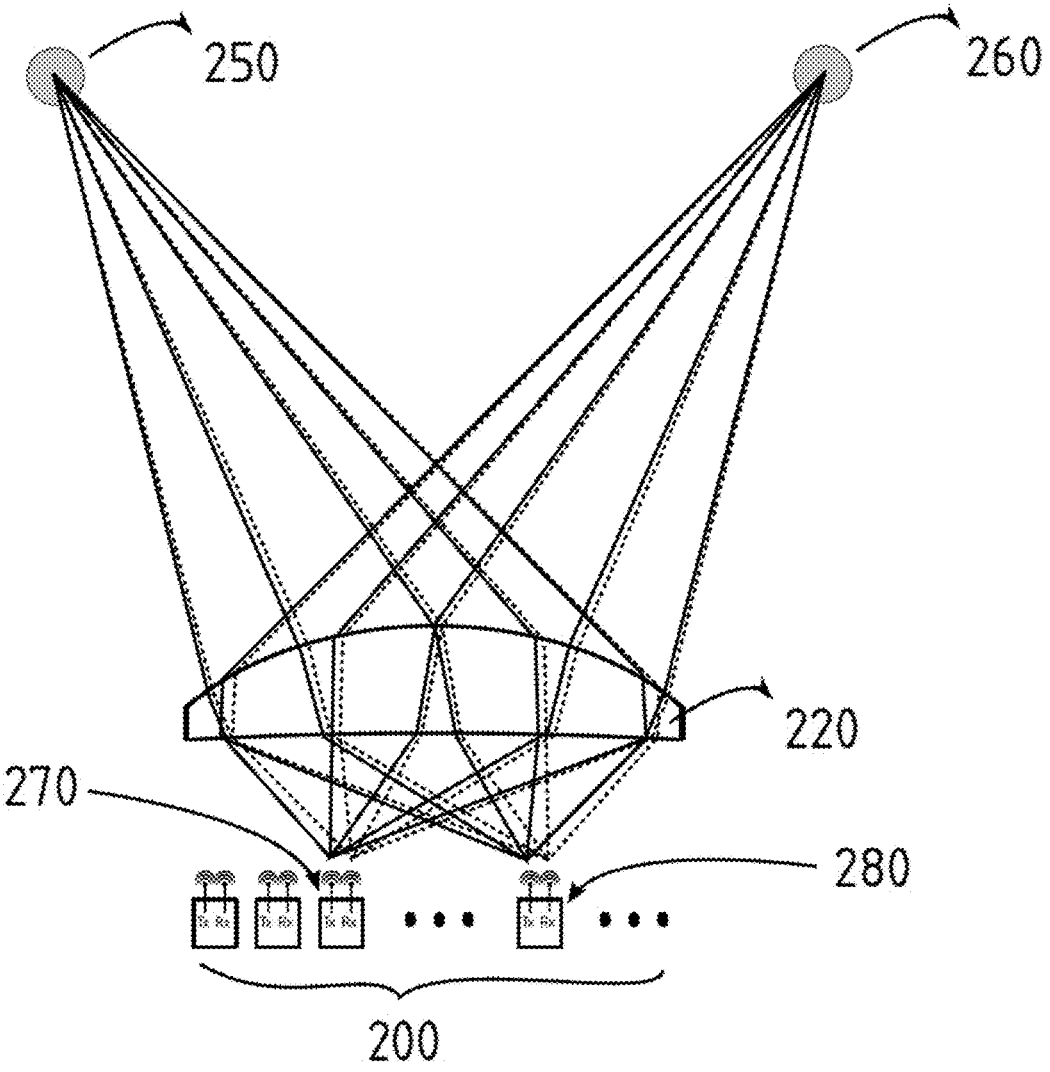

FIG. 2A is a schematic showing the working mechanism of the proposed retro-directive quasi-optical system. To simplify drawing, only a one-dimensional linear pixel array is shown. For each pixel of the pixel array 200, the EM waves emitted by its transmitter antenna 202 propagate along some wave paths expressed as the solid lines and arrive at the object 210, and the EM waves back-scattered or reflected from the object 210 propagate along other paths expressed as the dotted lines and arrive at the receiver antenna 203. That is to say, the pixel sends the EM waves to the object 210 through a lens-defined space channel, and then the same pixel receives the back-scattered or reflected EM waves through the same space channel. All the different wave propagation paths will converge into two conjugate positions at the opposite ends of the lens set 220: the object 210 and the pixel transmitting/receiving the EM waves. FIG. 2B is another schematic showing the working mechanism of the proposed retro-directive quasi-optical system. Again, only a one-dimensional linear pixel array is shown for simplifying the drawing. Two different objects 250/260 positioned on different portions of the accessible space defined by the lens set 220 are mapped to different pixels 280/270 of the pixel array 200 via different set of wave paths simultaneously as expressed by the solid lines and the dotted lines. In this way, if an object is moving through different portions of the accessible space defined by the lens set 220, by using different pixels of the pixel array 210 to continuously detect the moving object during a time period, the motion of the moving object may be efficiently monitored. Moreover, if only a portion of the accessible space has to be detected, only some corresponding pixels have to be turned on to save power.

Both the material and the design of the proposed retro-directive quasi-optical system are critical. For example, each lens of the lens set may be made of glass, quartz, plastics or other materials that are transparent to the EM wavelengths that the pixel array operates at. In addition, in the situation that the lens set is composed of one or more lenses, each lens may be a concave-concave lens, a convex-convex lens, a concave-convex lens, a convex-concave lens, a concave-planar lens, a convex-planar lens, a planar-concave lens or a planar-convex lens. Besides, each lens can also be a planar lens such as a Fresnel lens to reduce thickness and weight. In addition, the lens set may further include one or more elements, such as mirror(s), to deflect the optical axis of the EM wave propagating through, also may further include at least one element, such as the curved focusing reflector(s), capable of focusing EM wave (including curved focusing reflectors). Also, when the lens set is composed of two or more lenses, these lenses usually are centered and positioned along the optical axis of the lens set. In general, the pixel array is positioned on or near the focal plane of the lens set to optimize the image formed on the pixel array, but the distance between the pixel array and the lens set may be adjustable to further optimize the performance. In addition, the pixel array can be a one-dimensional array, a two-dimensional array, or even a three-dimensional array. Also, the pixel array can be arranged along a curvilinear line or on a curvilinear surface.

The pixel design is important such that the receiver within each pixel acquires enough energy transmitted, backscattered, or reflected from the corresponding space-channel-mapped object. Therefore, in general, the size of each pixel is equal to or smaller than the point-spread spot size, which encloses about 90% (Gaussian diameter definition) of the spread of the focused EM wave energy on the pixel array. The point-spread spot size is not only caused by lens diffraction, but also introduced by the lens aberration. Even though the lens aberration can be much reduced by design, the diffraction limited point-spread spot size in free-space is still half-wavelength at its smallest (in free space). The diffraction can be viewed as spatial frequency filtering that prevents the focusing system from reconstruct the image of the original point source. This spread in EM energy allows a reasonable distance between the receiver antenna(s) and the transmitter antenna(s) within the same pixel. Note that not only the details of both of the Tx antenna(s) and the Rx antenna(s) are not limited, but also the geometric relation between the transmitter antenna(s) and the receiver antenna(s) for each pixel is not limited. For example, on different embodiments, for each pixel, the Tx antenna(s) may surround the Rx antenna(s), the Rx antenna(s) may surround the Tx antenna(s), the Tx antenna(s) and the Rx antenna(s) may be placed side by side, the Tx antenna(s) may overlap with the Rx antenna(s), and the Tx antenna(s) may be separated from the Rx antenna(s).

The Tx and Rx antenna(s) within one pixel can be arbitrarily configured to cater applications that benefit from utilizing EM polarization. Interaction based on different polarization provides valuable information about the nature of the remote object. In addition, communication based on polarization coding becomes possible. To achieve this, the Tx and Rx antenna(s) can be designed to emit or receive either vertical or horizontal polarizations. One simple way to change from vertical to horizontal polarization is to simply rotate the antenna by 90 degrees. The Tx and Rx on the other hand can connect to the Tx and Rx antenna(s), respectively, through switches, thus independently enabling transmitters and receivers operating at different (or both) polarization states.

The Tx and Rx that belong to different pixels and/or the same pixel may be individually turned on or turned off. In the scenario when the proposed retro-directive quasi-optical system interacts with only a specific portion of the accessible space, only the corresponding pixels mapped to the this specific portion have to be enabled and the rest of pixels may be turned off. In this way, the overall power consumption of the proposed retro-directive quasi-optical system may be significantly reduced. In addition, a lot of transmitters and a lot of receivers may be enabled through a matrix network wherein numerous switchable connections between the Tx (and Rx) and the backend processing units are dynamically established.

The design of the lens set is critical to provide the desired accessible space that is suitable for different applications. For example, if the proposed retro-directive quasi-optical system is used to interact with objects distributed over a very wide area, the lens set may be designed to provide a wide FOV from about 90 degree to 180 degree or even higher. In contrast, if the proposed retro-directive quasi-optical system is used to interact with some objects positioned in a tighter space, for example, the communication with some devices positioned in an indoor hallway, the FOV of the lens set can be designed narrower and achieving higher resolution. The design of different lens sets includes changing materials and/or curvatures of at least one of the lens set. Furthermore, to have highest contrast and sharpness, alike to the applications of telescopes and/or microscopes, the size, the effective focal length, and other optical properties of the lens set may be designed.

The design of the pixel array is critical for different applications. For example, depending on the resolution requirement, both the amount and the distribution of the pixels are chosen carefully. For example, highest resolution is guaranteed by making the pixel spacing smaller than the point-spread spot size (oversampling.) In addition, depending on the frequency of the EM wave, not only both the size and shape of each pixel can be changed, but also the geometrical relation between neighboring pixels can be changed.

The EM waves emitted by different pixels can also be encoded to enhance resolution. Since the point-spread spot size or the half wavelength of the EM wave transmitted and/or received by the pixel array may be potentially larger than the pixel size in some situations, the receiver can use the transmitter coding information to recognize if the received signals are transmitted from their corresponding transmitter. In this way, a smaller effective spot size may be achieved, and the limitations imposed from the EM wavelength may be mitigated. This is another example that making the pixel spacing smaller than the point-spread spot size becomes valuable.

Figure 3A:
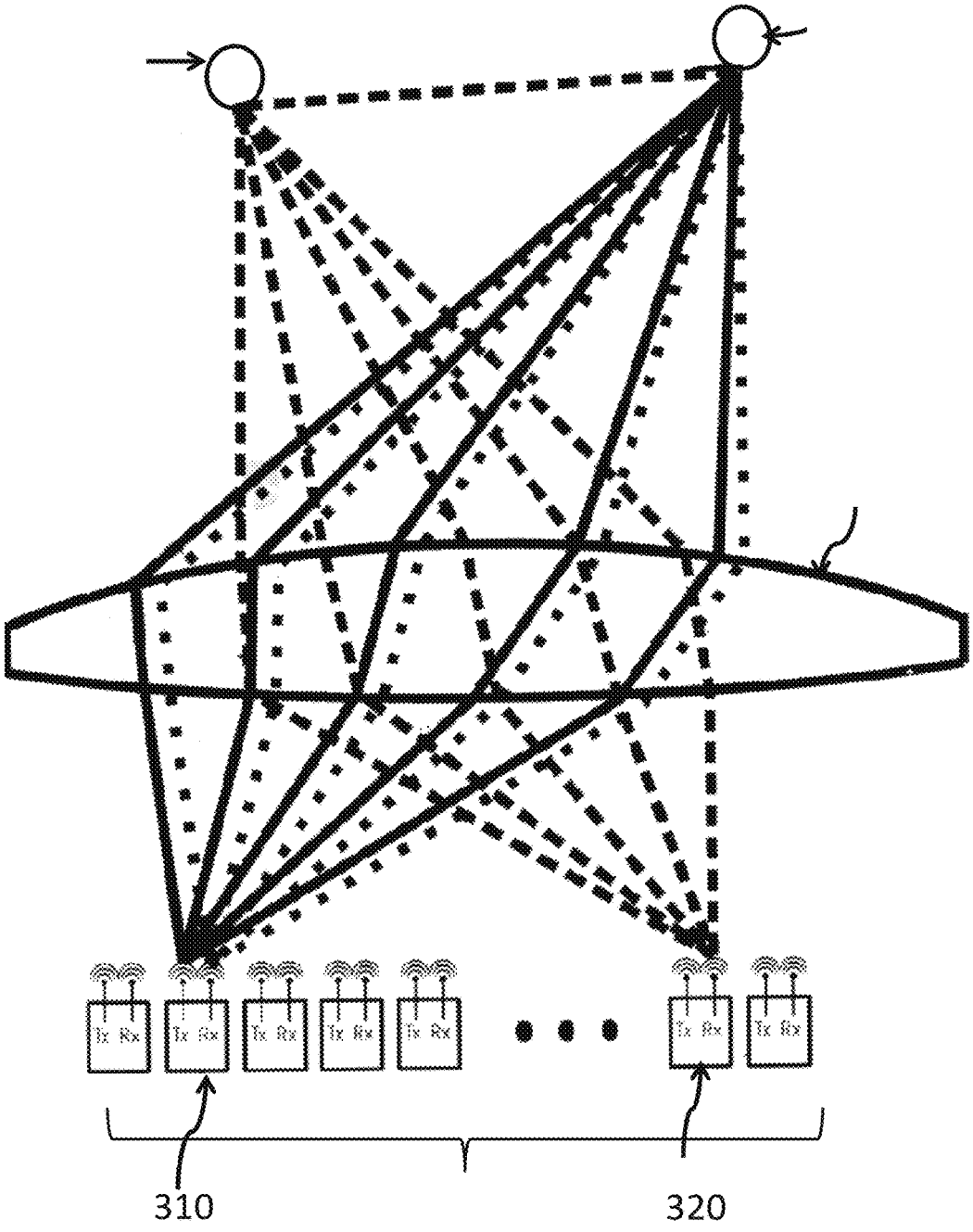
FIG. 3A illustrates a specific scenario of the proposed retro-directive quasi-optical system.

In addition, by encoding the EM waves emitted by different pixels individually, all multipath signals can both be seen and analyzed simultaneously because the coding mechanism provides an extra dimension for distinguishing the incoming signals for each pixel. To elaborate further, an example of operation is shown where only a one-dimensional pixel array is illustrated for simplicity. As shown in FIG. 3A, the EM waves, initially emitted by the pixel 310 of the pixel array 300, propagate through the lens set 350 to the distant object 360, which reflect and back-scatter the impinging EM waves that some portion of the scattered waves return to the lens set 350 and focus on the same pixel 310. However, there is an additional wave path that will return the echoed signals back to the pixel array 300: the distant object 360 may reflect or scatter the waves originated from the pixel 310 to another object 370. Some of the EM waves scattered by object 370 may propagate through the lens set 350 and eventually land on a different pixel 320, rendering a multipath signal. This result will lead to higher total received signal strength by processing all the recovered multipath signals at various pixels in the pixel array 300. Again, the solid line and the dotted line are used to express the wave paths of the EM waves propagating toward the object 360 and the EM waves propagating away from the object 360, respectively. This example shows how the multipath waves (dashed) can be seen (by the pixel 320) and analyzed. Now for the case when all pixels are turned-on simultaneously, all the multi-paths from all the distant objects may confuse the receiving pixels in the pixel array 300, when trying to figure out what portion of the received energy from each pixel belongs to which distant object. Hence, if the EM wave coding is applied, followed by analyzing the coded EM waves received by each of the pixels, even more information about the distribution and relative position of the objects 360/370 can be accurately assessed.

Figure 3B:
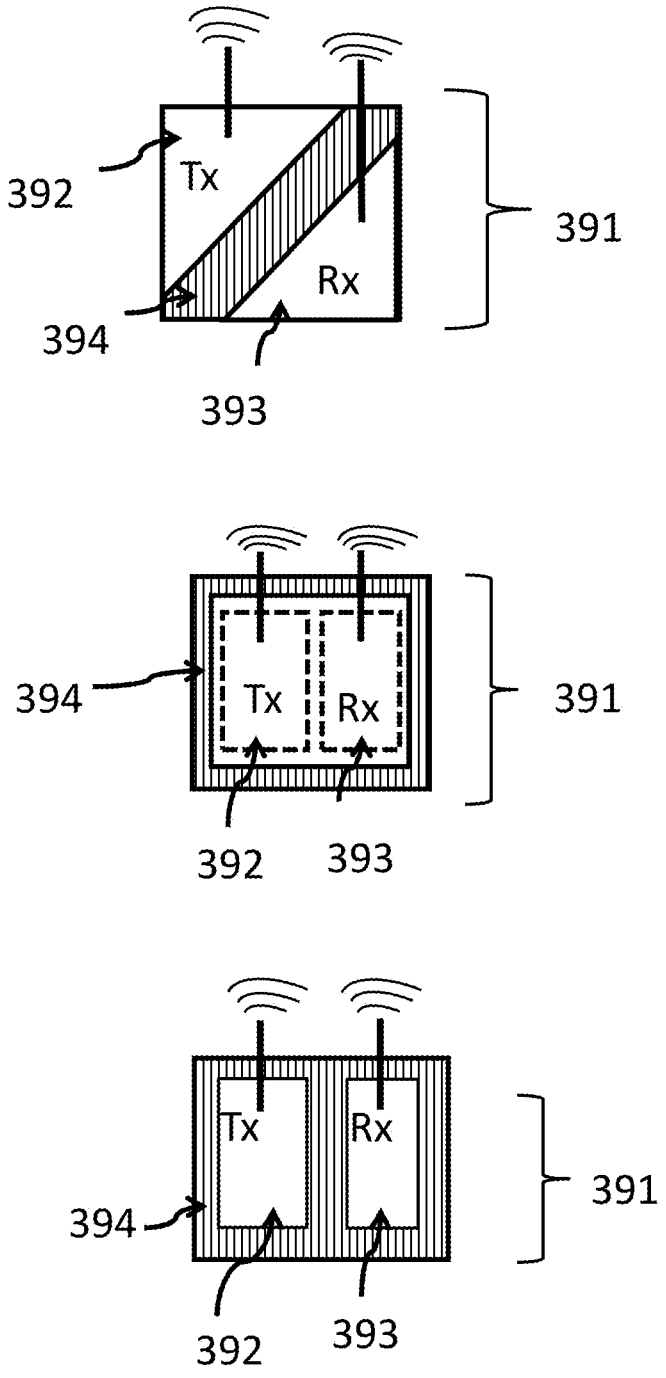
FIG. 3B illustrates some specific designs of the pixel of the pixel array of the proposed retro-directive quasi-optical system.

The proposed retro-directive quasi-optical system may include some additional devices other than the pixel array and the lens set. For example, to perform homodyne detection, a portion of the transmitted signal and the received signal within the same pixel are mixed by an internal mixer fed by a local oscillator. For example, the transmitter and the receiver within the same pixel are frequency-locked by a pair of internal mixer fed by a local oscillator. For another example, for each pixel of the pixel array, an isolation barrier (such as a structure made of absorbing material) may be used to isolate the transmitter antenna(s) and the receiver antenna(s) to prevent the emitted EM waves from coupling directly into the receiver without propagating through the lens set. Similarly, the isolation barrier between pixels can be inserted as well to prevent the EM waves from coupling directly from one pixel to its neighbors. FIG. 3B illustrates some specific design of the pixel of the pixel array of the proposed retro-directive quasi-optical system, wherein some optional geometrical relations between the pixel 391, the transmitter antenna 392, the receiver antenna 393 and the isolation barrier 394 are illustrated. For example, for at least one pixel 391, the isolation barrier 394 made of absorptive material is positioned inside the pixel 391 such that the transmitter antenna 392 and the receiver antenna 393 of the pixel 391 is separated by the isolation barrier 394. For example, for at least one pixel 391, the isolation barrier 394 made of absorptive material is positioned along the boundary of the pixel 391 such that both the transmitter antenna 392 and the receiver antenna 393 of the pixel 391 are surrounded by the isolation barrier 394. For example, for at least one pixel 391, the isolation barrier 394 made of absorptive material is positioned inside and along the boundary of the pixel 391 such that both of the transmitter antenna 392 and the receiver antenna 393 of the pixel 391 are surrounded by the isolation barrier 394.

The proposed retro-directive quasi-optical system may need some additional devices to function properly. For example, the pixel array may be coupled with an external circuit configured to power-on and -off and control the Tx and Rx individually, or to process the received data. The details of this external circuit, such as how the pixel array is coupled with this external circuit, are not limited. For example, these pixels of the pixel array may be coupled with the external circuit through switchable connections which control different pixels independently. The external circuit can also be interfaced with, for example, an FPGA (Field Programmable Gate Array), a microcontroller chip, or a microprocessor chip to perform controls and data acquisition.

Note that the operation frequency of the proposed retro-directive quasi-optical system is not limited, because similar EM wave behavior is applied to any lens systems. However, the proposed system prefers millimeter waves (mmWave) or terahertz (THz) frequencies. To explain, the point-spread spot size is mainly dominated by diffraction at lower frequencies, because the size of the lens is limited by manufacturing. If the frequency is too low, such as RF waves at a few GHz, the size of the lens becomes too large, heavy, and costly. On the other hand, at very high EM wave frequencies such as in the visible regime, the point-spread spot size becomes very small and fabricating optical lasers and detectors smaller than the point-spread spot size is very difficult. It turns out that increasing lens aberration would allow a larger real estate to fit one laser and one detector, but sacrificing resolution contradicts the one important reason to use optics. Therefore, the proposed system may be more suitable to operate at about 10 GHz to 750 GHz, or even 10 GHz to 1000 GHz, which encompasses most of the millimeter wave (30-300 GHz) and/or the terahertz (300 GHz-10 THz) domain, because the point-spread spot-size of mmWave and THz wave are more closely matched to the size of the pixel fabricated by current integrated circuit manufacturers. Tessmann et. al. reported a 0.15 micron p-HEMT 94 GHz single-chip FMCW radar module of chip size 0.36 lambda$^2$ in 2002. [Refer to "Compact Single-Chip W-Band FMCW Radar Modules for Commercial High-Resolution Sensor Applications," IEEE Transactions on Microwave Theory and Techniques, Vol. 50, No. 12, p. 2995-3001 (2002)] Wang et. al. demonstrated a 0.18 micron CMOS 10 GHz single-chip FMCW sensor of chip size 0.011 lambda$^2$ in 2009. [Refer to "Design of X-Band RF CMOS Transceiver for FMCW Monopulse Radar," IEEE Transactions on Microwave Theory and Techniques, Vol. 57, No. 1, p. 61-70 (2009)] The size of both the pixel of the pixel array and the lens of the lens set, therefore, may be scaled by using any well-known, on-developed, or to-be appeared technologies. Thus, the proposed retro-directive quasi-optical system may also be suitable for other EM waves with frequencies outside the range from 10 GHz to 1000 GHz while the size of both the lenses and each pixel elements may be scaled with the progress of technology.

Figure 4A:
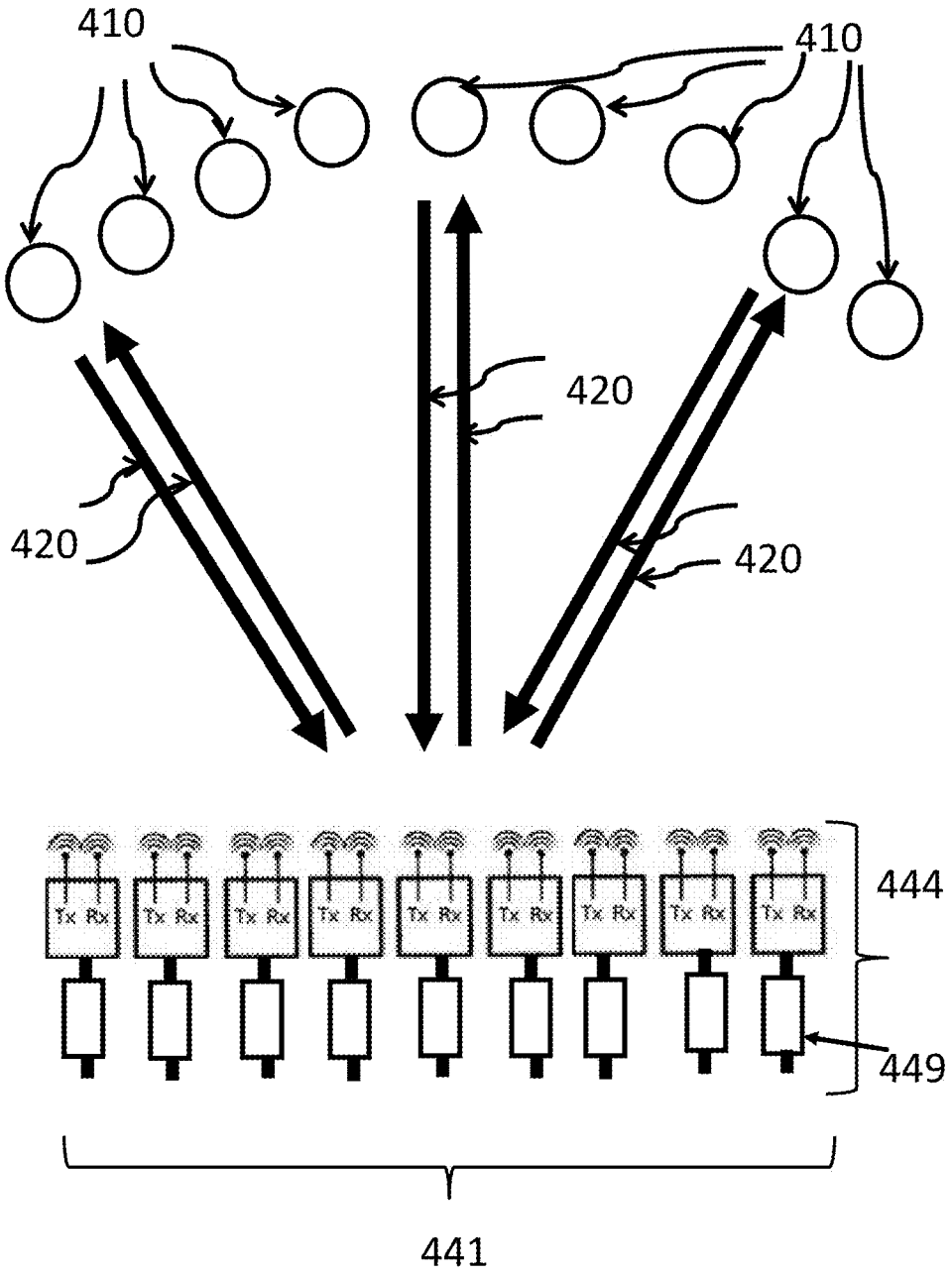
FIG. 4A, FIG. 4B and FIG. 4C illustrate the fundamental architecture of the conventional phased array system, the conventional lens-based image array system and the proposed retro-directive quasi-optical system respectively.
Figure 4B:
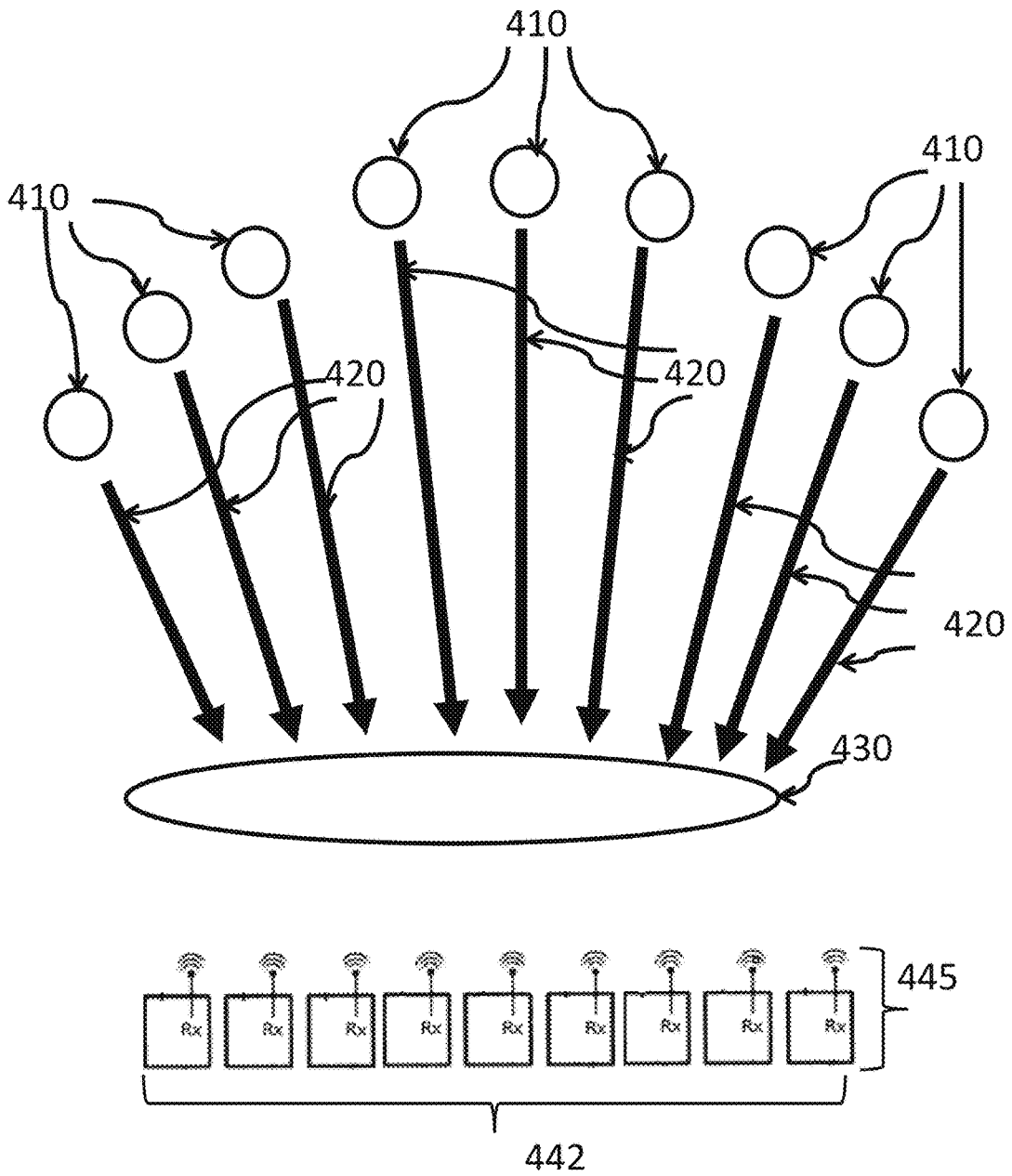
Figure 4C:
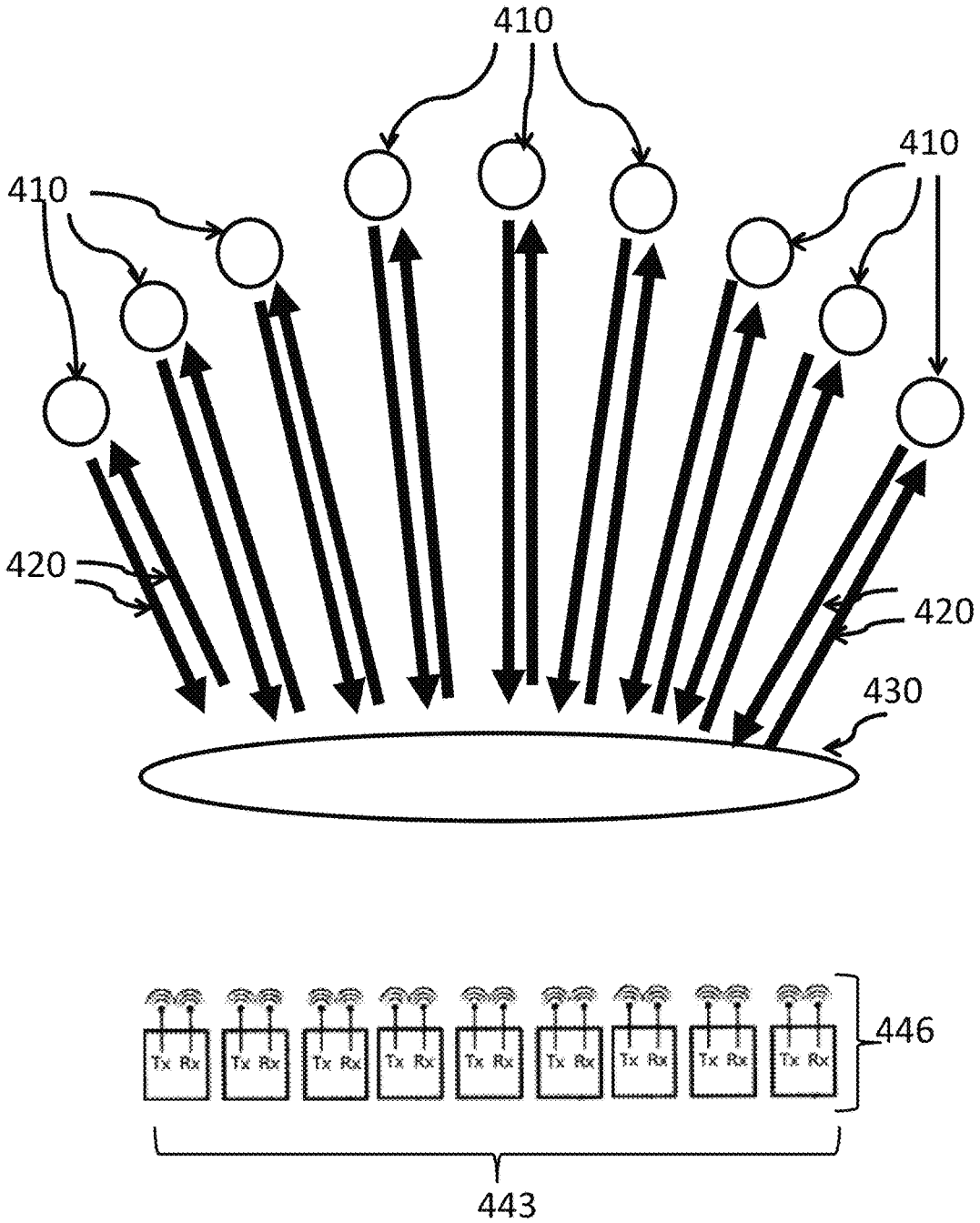

Benefits are manifested by comparing the proposed retro-directive quasi-optical system with both the conventional phased array system and the conventional lens-based image array system. FIG. 4A, FIG. 4B and FIG. 4C illustrate respectively the fundamental architecture of the phased array system, the conventional lens-based image array system, and the proposed retro-directive quasi-optical system. As shown in FIG. 4A, without sacrificing much power delivery, the conventional phased array system generates a few bi-directional beams 420 by properly controlling the phase and amplitude of each transmitting Tx or receiving Rx element in the units 444 in the array 441 to interact with a portion of these objects 410 at the same time. As shown in FIG. 4B, the conventional lens-based image system has some one-directional wave paths 420 connecting all of these objects 410 with the lens set 430 at the same time, and the array 442 has some pixels 445 that each has only the receiver antenna. As shown in FIG. 4C, the proposed retro-directive quasi-optical system has some (the number of the space channels depends on the number of pixels in the pixel array) bi-directional wave paths 420 connecting the lens set 430 with all of these objects 410, and the array 443 has some pixels 446 that each has both the receiver antenna and the transmitter antenna. In theses drawings, the labels Tx and Rx are used to indicate the transmitter and the receiver that connected to the Tx antenna and Rx antenna respectively, and the wave paths between the lens set 410 and the arrays 441/442/443 are omitted for simplifying drawings. Emphasized again that the wave paths 420 have different directionality among these systems, and they are bi-directional between the objects 410 and the arrays 441/443 for both the conventional phased array system and the proposed retro-directive quasi-optical system as opposed to the wave paths that is only one way from the objects 410 to the array 442 for the conventional lens-based image array. It should be emphasized again that the phased array system cannot interact with all remote objects simultaneously although both the phased array system and the proposed retro-directive quasi-optical system provide bi-directional interaction with remote objects. In addition, for the proposed invention, the retro-directive space channels between the pixel array and the remote objects are established by the lens set simultaneously. This also implies that the proposed retro-directive quasi-optical system may be reconfigured easily. For example, when monitoring only a specific portion of the accessible area, only the pixels that are mapped to this specific portion need to be turned on. In contrast, for the conventional phased array system, all transmitters and all receivers have to be operating together to synthesize the EM waves emitted by all phase shifting elements 449 to transmit power to the specific location(s). In addition, the proposed retro-directive quasi-optical system does not require controlling and computing power or impose delays while synthesizing the EM waves emitted by each of the transmitter antennas, and the operation and implementation of the proposed retro-directive quasi-optical system is much simplified. In summary, the proposed retro-directive quasi-optical system saves the total power consumption (no computation and phase-shifter power consumptions and EM wave loss), simplifies the operation (no heavy computing required and reduced latency), and facilitates the implementation (not much calibration effort and no extra analog circuitry for phase shifting). When comparing the conventional lens-based image array system to the proposed retro-directive quasi-optical system, it has only receivers but without transmitters in the pixels. Hence, the conventional lens-based image array system can only passively receive the EM waves transmitted from the objects with limited control over the external Tx source. Further, the proposed retro-directive quasi-optical system may actively explore a specific portion of the accessible space by only powering on the corresponding pixels, whereas the conventional lens-based image array system requires external transmitters and hardware that require additional alignment and calibration. This means that the proposed retro-directive quasi-optical system not only may actively detect remote objects, but also may detect remote objects with much less Tx total power. The efficient use of the power for emitting EM waves for the proposed retro-directive quasi-optical system opens the door for new mmWave and THz applications especially because the sources at these frequencies are typically power hungry and costly.

Figure 5A:
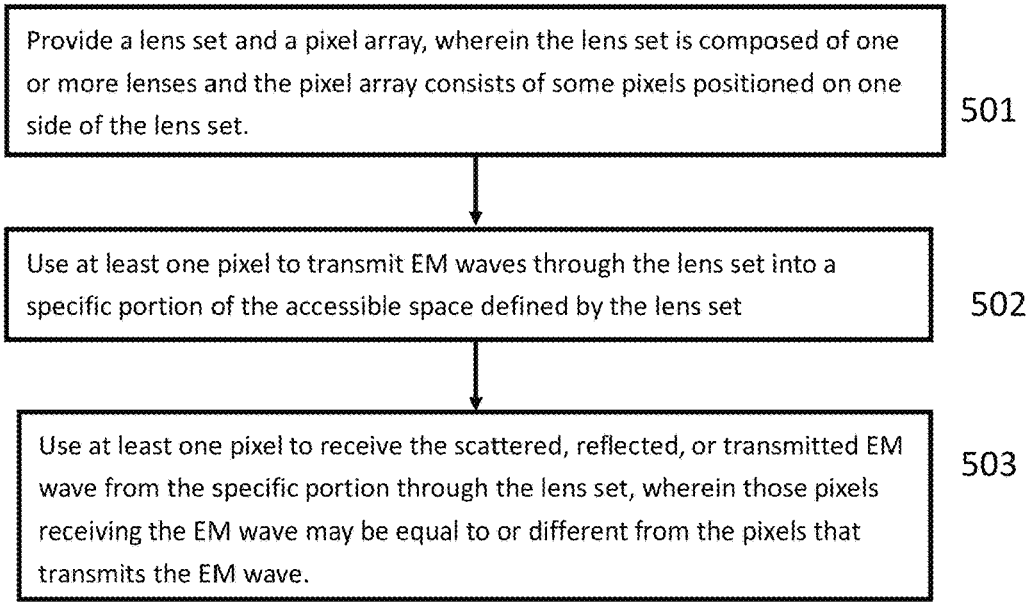
FIG. 5A and FIG. 5B are two flow charts to elaborate the method of operating the proposed retro-directive quasi-optical system.
Figure 5B:
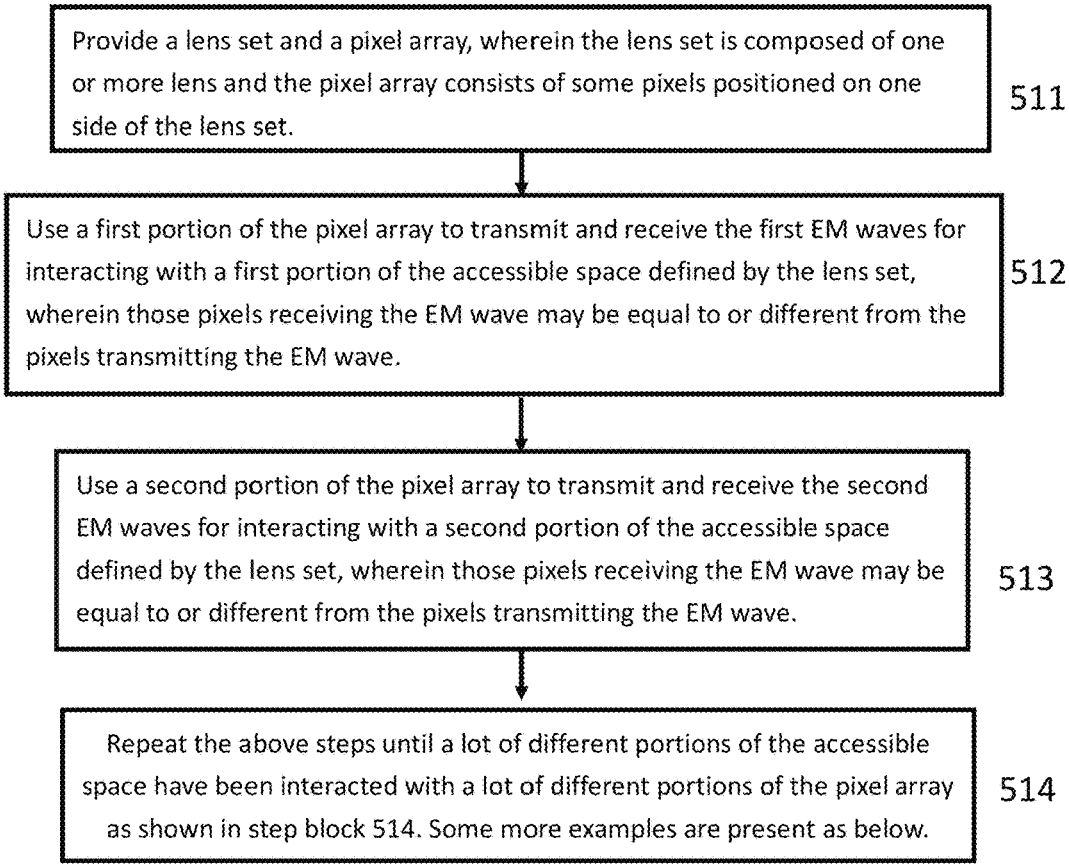

FIG. 5A shows a flow chart of the general operation of the proposed retro-directive quasi-optical system. Initially, as shown in block 501, provide a lens set and a pixel array, wherein the lens set is composed of one or more lenses and the pixel array consists of some pixels positioned on one side of the lens set. Next, as shown in step block 502, use at least one pixel to transmit EM waves through the lens set into a specific portion of the accessible space defined by the lens set. Then, as shown in step block 503, use at least one pixel to receive the scattered, reflected, or transmitted EM wave from the specific portion through the lens set, wherein those pixels receiving the EM wave may be equal to or different from the pixels that transmits the EM wave. FIG. 5B shows a flow chart to operate the proposed retro-directive quasi-optical system. Initially, as shown in step block 511, provide a lens set and a pixel array, wherein the lens set is composed of one or more lens and the pixel array consists of some pixels positioned on one side of the lens set. Next, as shown in step block 512, use a first portion of the pixel array to transmit and receive the first EM waves for interacting with a first portion of the accessible space defined by the lens set, wherein those pixels receiving the EM wave may be equal to or different from the pixels transmitting the EM wave. Then, as shown in step block 513, use a second portion of the pixel array to transmit and receive the second EM waves for interacting with a second portion of the accessible space defined by the lens set, wherein those pixels receiving the EM wave may be equal to or different from the pixels transmitting the EM wave. After that, repeating the above steps until a lot of different portions of the accessible space have been interacted with a lot of different portions of the pixel array as shown in step block 514. Some more examples are present as below. To remotely detect all objects spatially distributed in the accessible space in a specific moment, all pixels may be turned on simultaneously. To identify whether a smaller object is abut on a larger object with similar reflectivity, some pixels mapped to the larger object and its neighborhood may be operated repeatedly with a different focusing condition, namely, by changing the distance between the pixel array and the lens set, such that the existence of the smaller object may be decided by comparing these acquired images. To trace the motion of an object moving inside the accessible space during a period of time, after the position of the object has been found in a starting moment, different pixels may be turned on and operated in sequence to acquire the images of the object at different moments. To continuously communicate with different devices distributed inside the accessible space defined by the lens set during a time period, only the pixels mapped to these devices have to be operated continuously during this time period. To find targeted objects that are appearing in the accessible space anytime and anywhere during a time period, all pixels may be turned on with a specific order (such as in sequence) so that the pixel array may interact with different portions of the accessible space with a specific order to track the objects.

Figure 6:
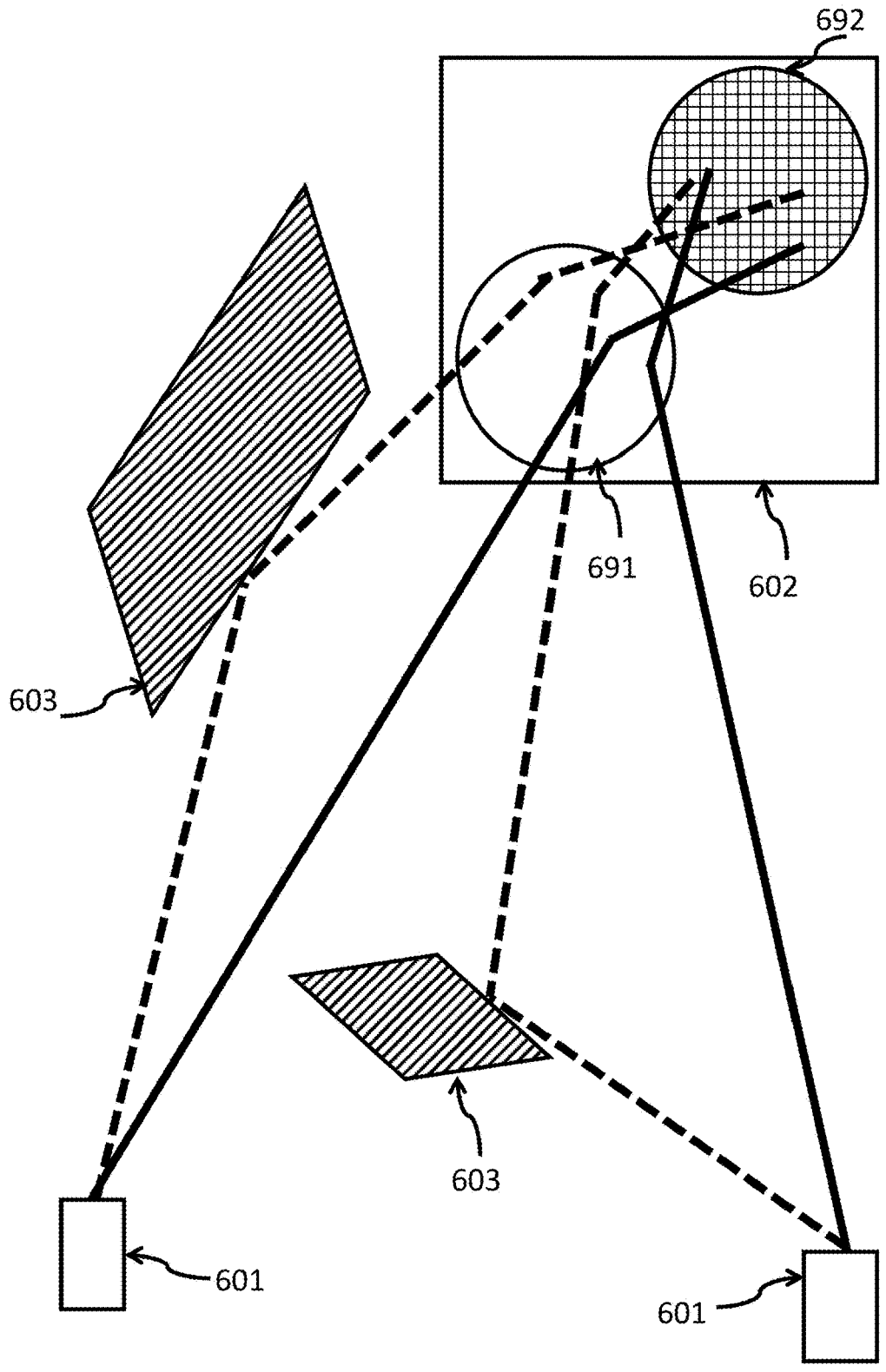
FIG. 6 illustrates one exemplary commercial application of the proposed invention.

One exemplary commercial application of the proposed invention is the low-power and fast-switching wireless base station. The wireless base station has one to several lens(es) (i.e., the lens set) to focus the incoming EM waves onto an array of pixels (i.e., the pixel array) positioned on the focal plane of the lens set, wherein each pixel (e.g., each array element) has dimensions as small as about half- to one-wavelength of the EM waves that the wireless base station operates at correspondingly and comprises a pair of Tx antenna and Rx antenna. As shown in FIG. 6, when operating in the receiving mode, two mobile phones 601 send the RF waves with proper coding for high-speed, high-throughput mobile communication without knowing the location of the wireless base station 602. For simplicity, only one ray (wave path) for each space channel is illustrated. The RF signals may reach the base station directly (line of slight) or indirectly (reflected through one or more objects 603, namely, multi-path) with an embedded retro-directive quasi-optical system, herein the solid line and the dotted line are used to express the two kinds of wave path: direct line-of-sight (solid) and multipath (dashed), respectively. When the multi-path RF signals reach the retro-directive quasi-optical system of the wireless base station 602, the lens focusing mechanism enables the distinction of the incoming multi-path RF signals in view of the angle of arrival as does the lens. Herein, the lens set 691 and the pixel array 692 are illustrated to show how the RF waves propagate through the lens set 691 onto the pixel array 692. Thereby, the receiving-RF-signal-strength-indicator (RSSI) turns on, and the awake of four pixel array elements for the mobile terminal emitting the request signals may be observed. The RSSI signals, consequently, turn on the transmitter modules which are in line with the adjacent receiving antenna of the same pixel array elements. The wireless base station then transmits signals through the incoming RF signal paths reversely, abiding by the reciprocity principle, thus enabling the handshaking between the mobile phone 601 and the base station 602 almost instantly. Further, when operating in the broadcasting mode, all transmitters on the pixel array 692 are turned on and the broadcasting signals are sent out to reach every corner of the desired region to be covered (or viewed as reach all portion of the accessible space defined by the lens set 691). Once the mobile phones 601 accept the invitation, it returns the call with its RF signal paths following the similar description of the receiving mode, and the base station 602 immediately knows who is returning the broadcast from where without performing search for the positions of the mobile phones 601. Specifically, the spatial Fourier transform uniquely defines the space propagation channels, and eliminate computationally intensive beamforming and beam-steering in massive MIMO or phased array communication systems. However, in certain specific occasions, e.g., the region where larger signal to noise ratio is required for signal integrity, these transmitters in the pixel array 692 may selectively emit higher RF power. Besides, when the mobile phones 601 move out of the zone into the adjacent zone illuminated by the base station 602, the base station 602 immediately knows the moving direction of the mobile 601 and switch to the desired transmitter, re-connecting the communication seamlessly. In addition, in principle, the amount of the mobile devices supported by such base station is the product of the number of the pixel array elements and the number of mobile devices allowable in each pixel array element. In additional, the ultra high-speed communication nature depends primarily on 1) the RSSI turn-on delay time, 2) the time required for switching multiple-inputs and multiple-outputs, in the form of either analog baseband (IF) or digital baseband. The total switching time is in the order of less than 1.0 microsecond using modern electronic technique.

Although the invention has been described with respect to certain embodiments, the embodiments are intended to be exemplary, rather than limiting. Modifications and changes may be made within the scope of the invention, which is defined by the appended claims.

What is claimed is:

1. A retro-directive quasi-optical system, comprising:

a lens set which is composed of one or more lens; and a pixel array which consists of some pixels;

wherein the pixel array is positioned on one side of the lens set;

wherein each pixel is composed of one or more transmitter antenna(s) and one or more receiver antenna(s).

2. The system of claim 1, further comprising at least one of the following:

each transmitter antenna is connected to one or more transmitter(s) and each receiver antenna is connected to one or more receiver(s); and each transmitter is connected to one or more transmitter antenna(s) and each receiver is connected to one or more receiver antenna(s).

3. The system of claim 1, further comprising one or more of the following:

the physical size and boundary of each pixel is defined by the combined area of both the transmitter antenna(s) and the receiver antenna(s);

the transmitter and the receiver may be fully or partially positioned inside the pixel; and the transmitter and the receiver may be fully positioned outside the pixel.

4. The system of claim 1, further comprising at least one of the following:

the size of each pixel is equal to or smaller than the point-spread spot size of the EM waves propagating through the lens set;

the size of the combination of the transmitter antenna(s) and the receiver antenna(s) of each pixel is equal to or smaller than the point-spread spot size of the EM waves propagating through the lens set;

the size of the combination of the transmitter antenna(s), the receiver antenna(s), the transmitter(s), and the receiver(s) of each pixel is equal to or smaller than the point-spread spot size of the EM waves propagating through the lens set; and the largest distance between the receiver antenna(s) and the transmitter antenna(s) of each pixel is not larger than the point-spread spot size of the focused EM waves;

wherein the point-spread spot size encloses about 90% (Gaussian diameter definition) of the spread of the focused EM wave energy on the pixel array.

5. The system of claim 1, wherein the accessible space is defined by the optical properties of the lens set, wherein the optical properties is chosen from a group consisting of the following: field of view, effective focal length, and f-number.

6. The system of claim 2, wherein at least one transmitter can adjust the frequency, the phase, the polarization, and/or the magnitude of the generated EM wave.

7. The system of claim 2, further comprising at least one of the following:

the Tx and Rx antenna(s) within one pixel can be arbitrarily configured to cater applications that benefit from utilizing EM polarization;

the Tx and Rx antenna(s) within one pixel can be designed to emit or receive either vertical or horizontal polarizations;

each of the Tx and Rx antenna(s) can be rotated by 90 degrees; and the Tx and Rx can connect to the Tx and Rx antenna(s), respectively, through switches, which independently enables transmitters and receivers operating at different polarization states.

8. The system of claim 2, further comprises at least one of the following:

the EM waves emitted by different pixels can be encoded;

the receiver can use the transmitter coding information to recognize if the received signals are transmitted from their corresponding transmitter;

the EM waves emitted by different pixels are encoded individually such that all multipath signals can be seen and analyzed simultaneously.

9. The system of claim 2, further comprising one or more of the following:

the transmitters and the receivers include circuit elements that convert the electrical signal into the outgoing EM wave and circuit elements that convert the incoming EM wave into the electrical signal, respectively;

the circuit elements include devices that filter and/or amplify the electromagnetic signals;

the circuit elements include EM splitters and/or EM combiners;

the circuit elements include emitters and/or oscillators for Tx; and the circuit elements include detectors and/or mixers for Rx.

10. The system of claim 2, further comprising one or more of the following:

a lot of transmitters and a lot of receivers are coupled with a few circuitries through a matrix network wherein numerous switchable connections between the transmitter (and receiver) and the backend processing units are dynamically established;

the transmitter and the receiver within the same pixel are frequency-locked by a pair of internal mixer fed by a local oscillator; and a portion of the transmitted and the received signal within the same pixel are mixed by an internal mixer fed by a local oscillator to down- or up-convert the signals.

11. The system of claim 2, further comprising one or more of the following:

different transmitters belonged to different pixels are turned on and turned off independently;

different receivers belonged to different pixels are turned on and turned off independently;

different transmitters belonged to the same pixel are turned on and turned off independently; and different receivers belonged to the same pixel are turned on and turned off independently.

12. The system of claim 1, further comprising at least one of the following:

at least one lens of the lens set is a concave-concave lens;

at least one lens of the lens set is a convex-convex lens;

at least one lens of the lens set is a concave-convex lens;

at least one lens of the lens set is a convex-concave lens;

at least one lens of the lens set is a concave-planar lens;

at least one lens of the lens set is a convex-planar lens;

at least one lens of the lens set is a planar-concave lens;

at least one lens of the lens set is a planar-convex lens;

at least one lens of the lens set is a Fresnel lens;

at least one element of the lens set is a mirror;

at least one element of the lens set is capable of deflecting the optical axis of the EM wave propagated through;

at least one element of the lens set is a curved focusing reflector; and at least one element of the lens set is capable of focusing EM wave.

13. The system of claim 1, further comprising at least one of the following:

these pixels are arranged as a one-dimensional array;

these pixels are arranged along a curvilinear line;

these pixels are arranged as a two-dimensional array;

these pixels are arranged along a curvilinear surface;

these pixels are arranged as a three-dimensional array; and the pixel array spacing is smaller than the point-spread spot size to achieve the highest resolution, wherein the point-spread spot size encloses about 90% (Gaussian diameter definition) of the spread of the focused EM wave energy on the pixel array.

14. The system of claim 1, further comprising at least one of the following:

an isolation barrier made of absorptive material is positioned along the boundary of at least one pixel, and the transmitter antenna(s) and the receiver antenna(s) of the same pixel is surrounded by the isolation barrier;

an isolation barrier made of absorptive material is positioned inside at least one pixel, wherein the transmitter antenna(s) and the receiver antenna(s) of the same pixel is separated by the isolation barrier; and an isolation barrier made of absorptive material is positioned inside and along the boundary of at least one pixel, wherein both of the transmitter antenna(s) and the receiver antenna(s) of the same pixel are surrounded by the isolation barrier.

15. The system of claim 1, further comprising at least one of the following:

the pixel array is positioned on or near the focal plane of the lens set;

the lens set is composed of two or more lenses positioned along the optical axis of the lens set;

a lens driving mechanism for moving or tilting at least one lens of the lens set; and a pixel driving mechanism for moving or tilting at least one pixel of the pixel array.

16. The quasi-optical system of claim 1, further comprising at least one of the following:

the pixel array and the lens set operate at about 10 GHz to about 750 GHz;

the pixel array and the lens set operate at about 10 GHz to about 1000 GHz;

the pixel array and the lens set operate within the millimeter wave or terahertz domain; and the pixel array and the lens set operate within the frequency range that its wavelength matches or is larger than the combined size of the transmitter antenna and the receiver antenna of a single pixel.

17. The method of operating the retro-directive quasi-optical system of claim 1, comprising:

providing a lens set and a pixel array, wherein the lens set is composed of one or more lenses and the pixel array consists of some pixels positioned on one side of the lens set;

using at least one pixel to transmit EM wave through the lens set into a specific portion of the accessible space defined by the lens set; and using at least one pixel to receive the EM wave scattered, reflected, or transmitted from the remote objects through the lens set, wherein those pixels receiving the EM wave may be equal to or different from the pixels that transmits the EM wave.

18. The method of claim 17, further comprising at least one of the following:

all pixels being turned on simultaneously to remotely detect all objects spatially distributed in the accessible space in a special moment; and some pixels mapped to a larger object and its neighborhood being operated repeatedly with different focusing condition to identify whether a smaller object is abut on the larger object by comparing these acquired images.

19. The method of claim 17, further comprising one or more of the following:

different pixels being turned on and operated in sequence to acquire the images of an object at different moments after the position of the object has been found at a starting moment to acquire the trajectory of the object to trace the motion of the object moving inside the accessible space during a period of time;

only the pixels mapped to different remote devices/objects being active during a time period to continuously communicate with those devices/objects distributed inside the accessible space defined by the lens set during the time period; and all pixels being turned on and operated with a specific order so that the pixel array may interact with different portions of the accessible space defined by the lens set with a specific order to find the objects appeared in the accessible space anytime and anywhere during a time period.

20. The method of operating the retro-directive quasi-optical system of claim 1, comprising:

providing a lens set and a pixel array, wherein the lens set is composed of one or more lens and the pixel array consists of some pixels positioned on one side of the lens set;

using a first portion of the pixel array to transmit and receive the first EM waves for interacting with a first portion of the accessible space defined by the lens set, wherein those pixels receiving the EM wave may be equal to or different from the pixels transmitting the EM wave;

using a second portion of the pixel array to transmit and receive the second EM waves for interacting with a second portion of the accessible space defined by the lens set, wherein those pixels receiving the EM wave may be equal to or different from the pixels transmitting the EM wave; and repeating the above steps until a lot of different portions of the accessible space has been interacted with a lot of different portions of the pixel array.

* * * * *